United States Patent [19]

Malec

[11] 4,242,099

[45] Dec. 30, 1980

[54] FUEL ADDITIVE FOR DIESEL FUELS

[75] Inventor: Robert E. Malec, Birmingham, Mich.

[73] Assignee: Ethyl Corporation, Richmond, Va.

[21] Appl. No.: 10,523

[22] Filed: Feb. 9, 1979

[51] Int. Cl.[3] ..... C10L 1/18

[52] U.S. Cl. ..... 44/53; 44/66; 44/70; 44/77

[58] Field of Search ..... 44/53, 56, 66, 70, 77

[56] References Cited

U.S. PATENT DOCUMENTS

| | | | |
|---|---|---|---|
| 2,934,048 | 4/1960 | Young | 44/57 |
| 3,234,131 | 2/1966 | Morway | 252/40.5 |
| 3,288,714 | 11/1966 | Osuch et al. | 252/57 |
| 3,687,644 | 8/1972 | Delafield et al. | 44/56 |
| 4,002,437 | 1/1977 | Broechx et al. | 44/66 |
| 4,128,403 | 12/1978 | Hornen | 44/71 |

FOREIGN PATENT DOCUMENTS

| | | | |
|---|---|---|---|
| 2701588 | 7/1978 | Fed. Rep. of Germany | 44/53 |

OTHER PUBLICATIONS

English Translation of Brazilian Patent Application No. P17700392.

*Primary Examiner*—Jacqueline V. Howard

*Attorney, Agent, or Firm*—Donald L. Johnson; Joseph D. Odenweller; Willard G. Montgomery

[57] ABSTRACT

An anti-wear compression ignition fuel for use in diesel engines comprising (1) a monohydroxy alkanol having from 1 to 5 carbon atoms, and (2) a wear inhibiting amount of a $C_{12}$ to $C_{30}$ hydrocarbyl succinic acid or anhydride, e.g. tetrapropenyl succinic acid. Optionally, said fuel composition may also contain an ignition accelerator such as an organic nitrate.

It has recently been disclosed in Brazilian Patent Application No. P17700392 that alcohols, such as methanol and ethanol, can be substituted for conventional petroleum derived diesel fuels for burning in diesel engines, when used in combination with an ignition accelerator, such as ethyl nitrate or nitrite. Reportedly, the addition of alkyl nitrate or nitrite accelerators to the alcohol achieves a level of auto-ignition sufficient to operate in diesel engines. Unfortunately, these fuel compositions, devoid of any petroleum derived products, are notably deficient in lubricity or lubricating properties with the result that engine wear from the use of these fuels in internal combustion reciprocating diesel engines is a serious problem. Of particular concern are wear problems associated with the fuel injector mechanism used in such engines. Wear problems have also been encountered in diesel engines operating on light diesel fuel oils as disclosed in U.S. Pat. No. 4,002,437.

8 Claims, No Drawings

FUEL ADDITIVE FOR DIESEL FUELS

The present invention relates to the use of certain hydrocarbyl succinic acids and anhydrides to reduce the wear properties of diesel fuel compositions of the alcohol or alcohol containing type. Alkenyl succinic acids and anhydrides and numerous derivatives thereof are well known in the art. For example, alkenyl succinic anhydrides in which the alkenyl group has a molecular weight of from about 900 to about 2,000 and is a polymer of a lower alkene are disclosed as detergents in lubricating compositions in U.S. Pat. No. 3,288,714. Also, in the case of fluid and semi-fluid lubricants containing relatively large amounts of a low molecular weight fatty acid salt, e.g. calcium acetate, U.S. Pat. No. 3,234,131 teaches that alkenyl succinic acid or the corresponding anhydride have been found useful as additives for improving the spreadability and inhibiting the gelling of the lubricant at high temperatures. U.S. Pat. No. 4,128,403 discloses, as a fuel additive having improved rust-inhibiting properties, a $C_{12}$ to $C_{30}$ hydrocarbyl succinic acid or anhydride in combination with (1) a hydrocarbyl amine containing at least one hydrocarbyl group having a molecular weight between 300 and 5,000; (2) a demulsifier; and (3) an inert hydrocarbon solvent. A gasoline composition containing the above-identified fuel additive is also disclosed.

SUMMARY OF THE INVENTION

It has now been found that the addition of a hydrocarbyl succinic acid or anhydride having from 12 to 30 carbon atoms to fuels adapted for use in diesel engines comprising a monohydroxy alkanol having from 1 to 5 carbon atoms and optionally containing an ignition accelerator, such as an organic nitrate, can significantly improve the wear characteristics of said fuels.

DESCRIPTION OF THE PREFERRED EMBODIMENTS

A preferred embodiment of the present invention is an anti-wear compression ignition fuel for use in diesel engines comprising (1) a monohydroxy alkanol having from 1 to 5 carbon atoms, and (2) a wear inhibiting amount of a hydrocarbyl succinic acid or anhydride having from 12 to 30 carbons.

Another embodiment of the present invention is an anti-wear compression ignition fuel for use in diesel engines comprising (1) a monohydroxy alcohol having from 1 to 5 carbon atoms, (2) an ignition accelerator, and (3) a wear inhibiting amount of a hydrocarbyl succinic acid or anhydride having from 12 to 30 carbon atoms.

Monohydroxy alcohols which can be used in the present invention include those containing from 1 to 5 carbon atoms. Preferred alcohols are saturated aliphatic monohydric alcohols having from 1 to 5 carbon atoms. Methanol, ethanol, propanol, n-butanol, isobutanol, amyl alcohol and isoamyl alcohol are preferred alcohols for use in the present invention. Of these, ethanol is the most preferred.

The hydrocarbyl succinic acid component of this invention preferably has from 12 to 30 carbons, and more preferably from 15 to 20 carbons. The hydrocarbyl-substituted succinic acid or anhydride may be prepared by the reaction of an olefin with maleic acid or maleic anhydride. For example, an alpha-olefin, such as those obtained from cracking wax (cracked wax olefins), is reacted with maleic anhydride or maleic acid to form an alkenyl succinic acid or anhydride. This product may then be hydrogenated to form the alkyl succinic anhydride or acid. However, in most instances there will be little advantage, if any, in the alkyl over the alkenyl succinic acid or anhydride. The methods of reacting an olefin with maleic anhydride are well known in the art and do not require exemplification here. Illustrative of various alpha-olefins which may find use are 1-dodecene, 1-tridecene, 1-tetradecene, 1-pentadecene, etc.

When the addition reaction with maleic anhydride is utilized, or otherwise, it is often desirable to use as the olefinic hydrocarbon reactant a low molecular weight polymer of a $C_2$ to $C_4$ olefin (i.e., an oligomer of $C_2$ to $C_4$ olefin). Such oligomers are represented by tetrapropylene, triisobutylene, tetraisobutylene, etc. Such oligomers are mono-olefins of a straight or branched chain structure.

A particularly preferred method in preparing the reaction product of this invention is the addition of the oligomer tetrapropylene to maleic acid anhydride or acid. The most preferred hydrocarbyl succinic acid component of this invention is tetrapropenyl succinic acid.

Optionally, the fuel composition of the present invention may contain an ignition accelerator. The ignition accelerator component of the anti-wear compression ignition fuel composition of the present invention is preferably an organic nitrate. Preferred organic nitrates are substituted or unsubstituted alkyl or cycloalkyl nitrates having up to about 10 carbon atoms, preferably from 2 to 10 carbon atoms. The alkyl group may be either linear or branched. Specific examples of nitrate compounds suitable for use in the present invention include, but are not limited to the following:

methyl nitrate
ethyl nitrate
n-propyl nitrate
isopropyl nitrate
allyl nitrate
n-butyl-nitrate
isobutyl nitrate
sec-butyl nitrate
tert-butyl nitrate
n-amyl nitrate
isoamyl nitrate
2-amyl nitrate
3-amyl nitrate
tert-amyl nitrate
n-hexyl nitrate
2-ethylhexyl nitrate
n-heptyl nitrate
sec-heptyl nitrate
n-octyl nitrate
sec-octyl nitrate
n-nonyl nitrate
n-decyl nitrate
n-dodecyl nitrate
cyclopentylnitrate
cyclohexylnitrate
methylcyclohexyl nitrate
isopropylcyclohexyl nitrate and the esters of alkoxy substituted aliphatic alcohols, such as 1-methoxypropyl-2-nitrate, 1-ethoxypropyl-2 nitrate, 1-isopropoxy-butyl nitrate, 1-ethoxybutyl nitrate and the like. Preferred alkyl nitrates are ethyl nitrate, propyl nitrate, amyl nitrates and hexyl nitrates.

Other preferred alkyl nitrates are mixtures of primary amyl nitrates or primary hexyl nitrates. By primary is meant that the nitrate functional group is attached to a carbon atom which is attached to two hydrogen atoms. Examples of primary hexyl nitrates would be n-hexyl nitrate, 2-ethylhexyl nitrate, 4-methyl-n-pentyl nitrate and the like. Preparation of the nitrate esters may be accomplished by any of the commonly used methods: such as, for example, esterification of the appropriate alcohol, or reaction of a suitable alkyl halide with silver nitrate.

Other conventional ignition accelerators may also be used in the present invention, such as hydrogen peroxide, benzoyl peroxide, etc. Further certain inorganic and organic chlorides and bromides, such as, for example, aluminum chloride, ethyl chloride or bromide may find use in the present invention as primers when used in combination with the alkyl nitrate accelerators of the present invention.

The amount of the hydrocarbyl succinic acid or anhydride present in the compression ignition fuel compositions of the present invention should be enough to provide the desired wear protection. This concentration is conveniently expressed in terms of weight percent of hydrocarbyl succinic acid or anhydride based on the total weight of the compression ignition fuel composition. A preferred concentration is from about 0.01 to about 2.0 weight percent. A more preferred range is from about 0.1 to about 1.0 weight percent.

The amount of alkyl nitrate or nitrite ignition accelerator used should be an amount which will achieve a level of auto-ignition sufficient to allow the operation of diesel engines on the fuel composition of the present invention. A useful range is from about 0.1 weight percent to about 10 weight percent based on the total weight of the compression ignition fuel composition. Preferred amounts are between 0.5 weight percent to 5.0 weight percent.

Other additives may be used in formulating the compression ignition fuel compositions of the present inventions. These compounds include demulsifying agents, corrosion inhibitors, antioxidants, dyes, and the like, provided they do not adversely effect the anti-wear effectiveness of the hydrocarbyl succinic acid or anhydride component of the present invention.

Conventional blending equipment and techniques may be used in preparing the fuel composition of the present invention. In general, a homogeneous blend of the foregoing active components is achieved by merely blending the hydrocarbyl succinic acid or anhydride component of the present invention with the monohydroxy alkanol and, if desired, ignition accelerator component of the present invention in a determined proportion sufficient to reduce the wear tendencies of the fuel. This is normally carried out at ambient temperature. The following examples illustrate the preparation of some typical fuel compositions of the present invention.

EXAMPLE I

To a blending vessel is added 1000 parts of 190 proof ethanol and 20 parts of a hydrocarbyl succinic acid or anhydride having from 12 to 30 carbons. The mixture is stirred at room temperature until homogeneous forming a fuel composition useful for reducing and/or inhibiting the amount of engine wear in internal combustion reciprocating diesel engines operating on said fuel composition.

EXAMPLE II

To a blending vessel is added 1000 parts of 190 proof ethanol, and 1 part of hydrocarbyl succinic acid or anhydride having from 12 to 30 carbons. The mixture is stirred at room temperature until homogeneous forming a fuel composition useful for reducing and/or inhibiting the amount of engine wear in internal combustion reciprocating diesel engines operating on said fuel composition.

The amounts of each ingredient in the foregoing compositions can be varied within the limits aforediscussed to provide the optimum degree of each property.

The lubricity or wear properties of the fuel compositions were determined in the 4-Ball Wear Test. This test is conducted in a device comprising four steel balls, three of which are in contact with each other in one plane in a fixed triangular position in a reservoir containing the test sample. The fourth ball is above and in contact with the other three. In conducting the test, the upper ball is rotated while it is pressed against the other three balls while pressure is applied by weight and lever arms. The diameter of the scar on the three lower balls are measured by means of a low power microscope, and the average diameter measured in two directions on each of the three lower balls is taken as a measure of the anti-wear characteristics of the fuel. A larger scar diameter means more wear. The balls were immersed in base fuel containing the test additives. Applied load was 5 kg and rotation was at 1,800 rpm for 30 minutes at ambient temperature. Tests were conducted both with base fuel* alone and base fuel containing the test additives. Results are as follows:

| Additive[1] Conc. (wt. %) | Scar Diameter (mm) Run 1 | Run 2 |
|---|---|---|
| None | 0.89 | 0.90 |
| 1.0 | 0.67 | |

[1]Tetrapropenyl succinic acid

*Base fuel was 190 proof ethanol.

In two separate tests, the test fuel without any additive gave scar diameters of 0.89 and 0.90 mm, respectively. The addition to the base fuel of tetrapropenyl succinic acid at a concentration of 1.0 weight percent significantly reduced the wear index to 0.67 mm. Thus, the incorporation of a hydrocarbyl succinic acid into alcohol or alcohol containing fuels significantly increases the wear inhibiting properties of these fuels. The hydrocarbyl succinic acids and anhydrides of the present invention are also effective anti-wear agents when used in fuel compositions comprising mixtures of monohydroxy alkanols having from 1 to 5 carbon atoms and fuel oil boiling above the gasoline boiling range, i.e. a mixture of hydrocarbons boiling in the range of from about 300° F. to about 700° F. Such compositions may also contain ignition accelerators such as the organic nitrates referred to previously.

Further, the hydrocarbyl succinic acids and anhydrides present invention are also effective anti-wear agents when used in diesel fuel compositions comprising a mixture of hydrocarbons boiling in the range of from about 300° F. to about 700° F. devoid of any alcohol components. Such fuel oil compositions comprise both the heavy and light diesel fuel oils which are commonly used at present as fuels in diesel motor vehicles.

Such fuel compositions may also contain ignition accelerators such as organic nitrates as well as other additives such as demulsifying agents, corrosion inhibitors, antioxidants, dyes, and the like commonly used in these types of fuel compositions.

Thus, another embodiment of the present invention is an anti-wear compression ignition fuel for use in diesel engines comprising a fuel oil boiling above the gasoline range containing a wear inhibiting amount of a hydrocarbyl succinic acid or anhydride having from 12 to 30 carbon atoms.

I claim:

1. As a new composition of matter, an anti-wear compression ignition fuel for use in diesel engines comprising (1) a monohydroxy alkanol having from 1 to 5 carbon atoms, (2) an ignition accelerator, and (3) a wear inhibiting amount of a hydrocarbyl succinic acid or anhydride having from 12 to 30 carbon atoms.

2. The composition of claim 1 wherein said monohydroxy alkanol is ethanol.

3. The composition of claim 1 wherein said ignition accelerator is a substituted or unsubstituted alkyl or cycloalkyl nitrate having up to 10 carbon atoms.

4. The composition of claim 1 wherein said hydrocarbyl succinic acid or anhydride is tetrapropenyl succinic acid.

5. The composition of claim 2 wherein said ignition accelerator is selected from methyl nitrate, ethyl nitrate, propyl nitrate, amyl nitrates, hexyl nitrates or a mixture of primary amyl nitrates and primary hexyl nitrates.

6. The composition of claim 5 wherein said ignition accelerator is ethyl nitrate.

7. The composition of claim 5 wherein said hydrocarbyl succinic acid or anhydride is tetrapropenyl succinic acid.

8. The composition of claim 7 containing from about 0.1 to about 10.0 weight percent ignition accelerator and from about 0.01 to about 2.0 weight percent tetrapropenyl succinic acid based on the total weight of said composition.

* * * * *